US006132238A

United States Patent [19]

Hartmann et al.

[11] Patent Number: 6,132,238

[45] Date of Patent: Oct. 17, 2000

[54] CONNECTOR FOR ELECTRICAL CONDUCTORS

[75] Inventors: Frank Hartmann, Porta Westfalica; Hans-Josef Köllmann, Minden, both of Germany

[73] Assignee: WAGO Verwaltungsgesellschaft mbH, Minden, Germany

[21] Appl. No.: 08/991,290

[22] Filed: Dec. 16, 1997

[30] Foreign Application Priority Data

Dec. 19, 1996 [DE] Germany ..... 196 54 523

[51] Int. Cl.[7] ..... H01R 4/24; H01R 4/26; H01R 11/20

[52] U.S. Cl. ..... 439/439; 439/787

[58] Field of Search ..... 439/787, 786, 439/439, 441, 723, 212, 213, 949, 511, 513, 952

[56] References Cited

U.S. PATENT DOCUMENTS

| | | | |
|---|---|---|---|
| 3,945,711 | 3/1976 | Hohorst et al. . | |
| 4,217,021 | 8/1980 | Illum | 439/787 |
| 4,230,388 | 10/1980 | Thierry et al. | 439/787 |
| 5,575,695 | 11/1996 | De Bernardis | 439/441 |

*Primary Examiner*—Neil Abrams
*Assistant Examiner*—Hae Moon Hyeon
*Attorney, Agent, or Firm*—Salter & Michaelson

[57] ABSTRACT

The invention concerns a connector of a construction type that is extremely sparing of material. A contact insert of the connector is formed of a simple busbar rod and a piece of spring steel sheet from which leaf springs are stamped out in the shape of tongues, whose punched-out tongue ends are aligned opposite the busbar rod, which preferably has a circular cross section.

18 Claims, 1 Drawing Sheet

CONNECTOR FOR ELECTRICAL CONDUCTORS

BACKGROUND OF THE INVENTION

The invention concerns a connector for electrical conductors with a housing of insulation material, in which a metal contact insert with at least two contact points is inserted.

The contact points are each formed between a leaf spring and a busbar, which is common to all contact points. The leaf springs are punched out in a type of tongue formation from a piece of spring steel sheet, whereby the tongue roots remain connected to one another via the spring steel sheet. The ends of the tongues that have been punched out each have a contact edge, which is aligned opposite the busbar, so that it forms with the busbar in each case a contact point for an electrical conductor to be connected.

Connectors of this type are known in multiple forms of embodiment, e.g., as connectors for connection boxes. They are produced in large series.

The task of the invention is to configure the metal contact insert for connectors of this type in a way that saves as much material as possible.

SUMMARY OF THE INVENTION

This task is resolved in that every two leaf springs are punched out in mirror-symmetrical manner to a central plane from the spring steel sheet in such a way that their tongue ends are distanced from one another and the sheet material between the tongue ends is stamped out (e.g., punched-out place) and that the busbar has the form of a rod (e.g., busbar rod), which is arranged in the stamped-out place and in the central plane.

In the case of the contact insert according to the invention, a strict functional separation is maintained. The busbar rod only takes on the task of current conduction and contacting of the electrical conductor. The piece of spring steel sheet with the leaf springs only has the task of introducing the clamping or binding force, i.e., no current runs over the spring material. Accordingly, the material for the respective component parts can be better utilized than is the case when the functional tasks are combined. The components may be extremely optimized relative to savings of material.

The busbar rod can be formed with a circular-round cross section and can be precisely adapted each time to the required current-conducting cross section, since it must exclusively fulfill the task of current conduction and current contacting. The contacting between a circular busbar rod and a one-wire (solid) electrical conductor inserted crosswise to the busbar rod is very good. The busbar rod, however, may also have any other desired cross-sectional form.

According to the instructions of the invention, the contact points lie in pairs mirror-symmetrically to a central plane, in which the busbar rod is arranged. In this way, a shortening (halving) of the length of the busbar rod can be produced with a pre-given number of contact points. This also saves material.

The piece of spring steel sheet with the leaf springs can be well adapted in the case of several contact points to the clamping forces increased thereby, in that, when the leaf springs are punched out from the spring steel sheet, a sheet material crosspiece remains behind between the adjacent pairs of leaf springs.

A particularly compact construction of the contact insert of the invention is produced if the piece of spring steel sheet with the leaf springs arranged in a mirror-symmetrical way to the central plane is bent back in V shape in the central plane. The contact insert in this way thus has smaller outer dimensions, and the angle of incidence of the leaf springs to the busbar rod improves the insertion of the electrical conductors into the respective contact points.

For a problem-free assembly of the contact insert into the housing of insulation material of the connector, it is advantageous, if the piece of spring steel sheet from which the leaf springs are stamped out is pre-mounted (prefixed) into a single unit with the busbar rod. For this purpose, the spring steel sheet in the central plane has an uptake channel that is U-shaped in cross section for taking up the busbar rod and that the busbar rod is locked in the uptake channel.

BRIEF DESCRIPTION OF THE DRAWINGS

An example of embodiment of the invention will be described in more detail below on the basis of the drawings. Here.

DETAILED DESCRIPTION OF THE PREFERRED EMBODIMENT

Figure 1:
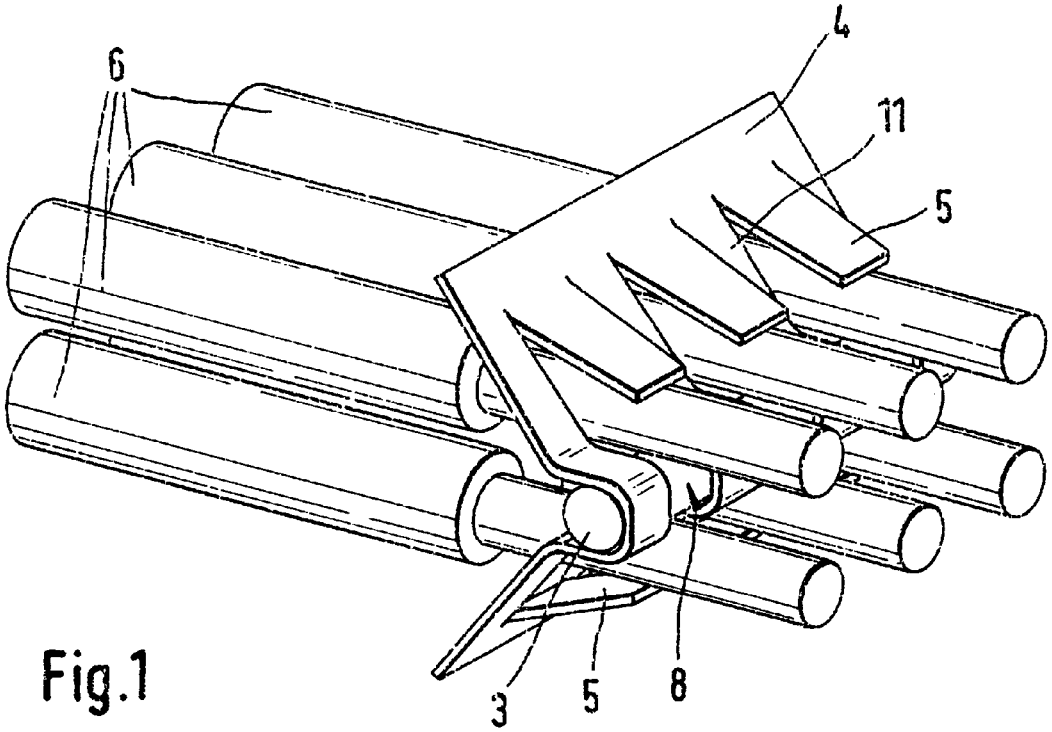
FIG. 1 shows a contact insert according to the invention.

FIG. 1 shows a circular busbar rod 3 and a V-shaped bent-back piece of spring steel sheet 4 with leaf springs 5 stamped out of it. In the contact points, which are formed each time between the ends of the tongues of the leaf springs and the busbar rod, an electrical conductor 6 is clamped.

Figure 2:
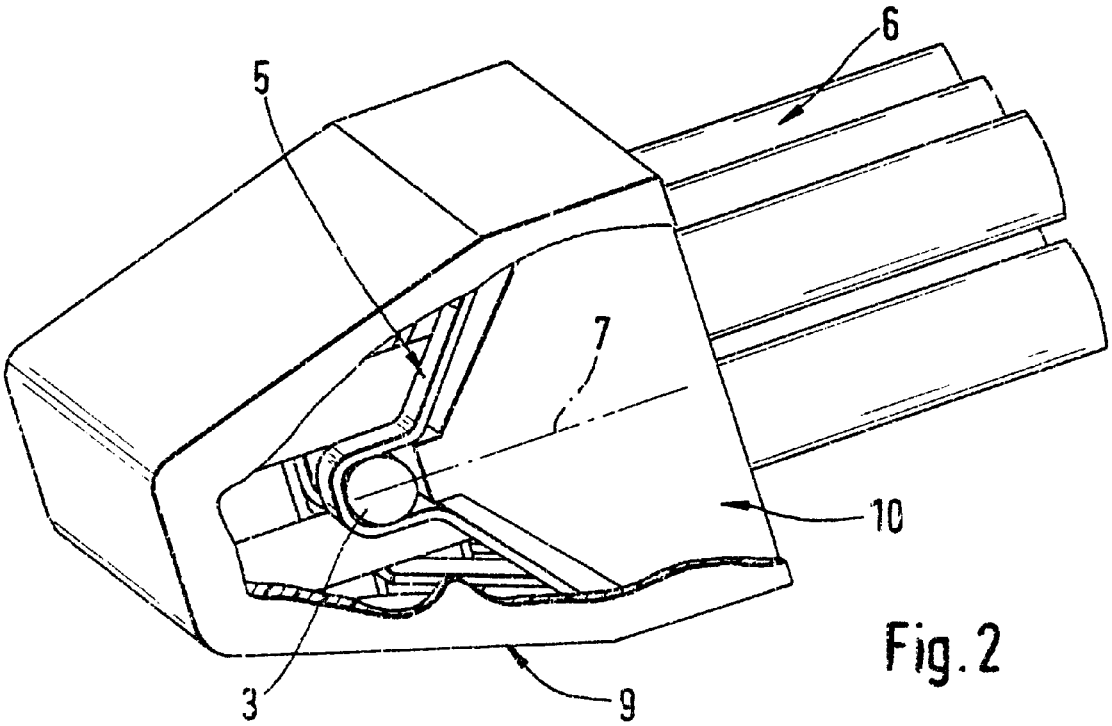
FIG. 2 shows the contact insert according to FIG. 1 in the mounted state in a housing of insulation material.

Leaf springs 5 are stamped out in tongue shapes from the piece of spring steel sheet 4 and in fact each two leaf springs are mirror-symmetric to a central plane 7 (see FIG. 2). The tongue ends of such leaf spring pairs are distanced from one another and the sheet material of the spring steel sheets is punched out between the ends of the tongues, so that the punched-out place 8 is formed. The punched-out place makes possible a direct contacting between busbar rod 3 positioned in the punched-out place and the electrical conductor.

Between the mirror-symmetric leaf spring pairs, which can be arranged in a row in any desired number adjacent to each other in the direction of the busbar rod, a sheet material crosspiece 11 is present, which adsorbs the forces resulting from the conductor binding. The contact insert formed from busbar rod 3 and the piece of spring steel sheet 4 with leaf springs 5 is self-supporting, so that the forces resulting from the conductor binding are not transmitted to the housing of insulation material of the connector.

Busbar rod 3 is inserted into a U-shaped uptake channel of the spring steel sheet, and the leaf-spring tongues punched out of the piece of spring steel sheet have a tongue length, which is dimensioned in such a way that the tongue ends lie somewhat behind the outer diameter of the busbar rod in their assembly state, (i.e., in their state without an electrical conductor inserted into the contact point), whereby a pre-mounting (prefixing) of the busbar rod in the U-shaped uptake channel of the spring steel sheet is given. Alternatively or additionally, the desired pre-mounting of the contact insert can also be achieved by employing a binding adaptation (binding seat) of the busbar rod in the U-shaped uptake channel.

The pre-mounted contact insert is introduced into the connector housing of insulation material 9 according to FIG. 2 by means of an opening for assembling on the front side, whereupon the opening for assembling is sealed with an insulating material cover 10 on the front side. The insulating-material cover 10 fixes the contact insert in the insulation-material housing.

What is claimed is:

1. A connector for electrical conductors comprising:

an insulating-material housing; and a metal contact insert with at least two contact points inserted into the housing, the contact points each being formed between a leaf spring and a busbar being common to all contact points; the leaf springs being punched out of a piece of spring steel sheet in the form of tongues, whereby tongue roots of the tongues remain joined with each other via the spring steel sheet, the punched-out tongue ends each having a clamping edge which is aligned opposite the busbar so that it forms with the busbar each time a contact points for an electrical conductor to be connected, wherein the improvement comprises that each two leaf springs being punched out in a mirror-symmetrical manner to a central plane from the piece of spring steel sheet in such a way that their tongue ends are distanced from one another and the sheet material is punched out between the tongue ends forming a punched-out place, and the busbar having the form of a rod which is arranged in the punched out-place and in the central plane such that the conductor is biasedly received between said clamping edge and said busbar and wherein the busbar is secured to the metal contact insert.

2. The connector according to claim 1, several leaf spring pairs that are mirror-symmetrical to the central plane being punched out of the piece of spring steel sheet, and a sheet material crosspiece being present each time between the adjacent leaf spring pairs.

3. The connector according to claim 1, the piece of spring steel sheet being bent back in V-shaped manner in the central plane.

4. The connector according to claim 1, the piece of spring steel sheet having in central plane an uptake channel that is U-shaped in cross section for uptake of the busbar rod.

5. The connector according to claim 4, the busbar rod being locked into the uptake channel.

6. The connector according to claim 1, the busbar rod having a circular cross section.

7. The connector according to claim 1, wherein the busbar is secured to the spring steel sheet.

8. The connector according to claim 1, wherein each end of the busbar is secured to the insulating-material housing.

9. The connector according to claim 4, wherein each end of the busbar is secured to the insulating-material housing.

10. A connector for electrical conductors comprising:

an insulative housing;

a contact disposed within said housing, said contact comprising a metal sheet generally formed into a V-shape, including first and second opposing half-sections joined at a vertex of the V-shaped sheet, the vertex defining a longitudinal axis of the contact; and a busbar disposed along said vertex of said contact, said busbar lying parallel to said longitudinal axis and secured to the contact;

wherein said first and second opposing half-sections are mirror-images of each other, each including at least one punched-out leaf spring portion which is capable of being deflected away from said busbar;

said contact being constructed and arranged such that a conductor is biasedly receivable between each of said at least one punched-out spring portion and said busbar.

11. The connector according to claim 10, wherein the busbar is secured to the spring steel sheet.

12. The connector according to claim 10, wherein each end of the busbar is secured to the insulating-material housing.

13. A connector for electrical conductors comprising:

an insulating-material housing;

a metal contact disposed within the housing, the metal contact having at least two clamping units each for an electrical conductor to be connected and one current busbar common to all clamping units;

the clamping units each being formed between a leaf spring and the current busbar, the leaf springs being punched out of a flat spring steel sheet in the forms of tongues, whereby the roots of the tongues remain joint with each other via the spring steel sheet and the free ends of the tongues each having a clamping edge directed against the busbar, so that it forms with the surface of the current busbar a clamping unit;

the improvement comprising:

that each two leaf springs being punched out in a mirror-symmetrical manner to a central plane in such a way that their tongue ends are at a distance to each other;

that the sheet material is cut away in the area of distance between the tongue ends to allow the clamping edge of the tongue ends to form the clamping units against the surface of the current busbar;

the current busbar having the form of a rod placed in the cut-away-area and in the central plane and being fixed in that position either by being secured to the spring steel sheet or by being carried in the housing.

14. A connector according to claim 13, wherein a plurality of pairs of mirror-symmetric leaf springs are arranged adjacent to each other along the busbar rod, and an intermediate piece of sheet material being present each time between the adjacent leaf spring pairs to absorb the clamping forces resulting from the clamping of an electrical conductor in the clamping units.

15. A connector according to claim 13, wherein the spring steel sheet is formed into a V-shape, the vertex of which is placed in the central plane.

16. A connector according to claim 13, wherein the spring steel sheet has a U-shaped uptake channel placed in the central plane and adapted to uptake the current busbar rod.

17. A connector according to claim 15, wherein the busbar rod is locked into the uptake channel.

18. A connector according to claim 16, wherein the busbar rod has a circular cross section.

* * * * *